United States Patent [19]

Bert

[11] Patent Number: 4,503,665

[45] Date of Patent: Mar. 12, 1985

[54] NON-EXPANSIBLE LINKAGE BRACELET

[75] Inventor: Stephen F. Bert, West Warwick, R.I.

[73] Assignee: Textron, Inc., Providence, R.I.

[21] Appl. No.: 503,801

[22] Filed: Jun. 13, 1983

[51] Int. Cl.[3] ..... F16G 13/00

[52] U.S. Cl. ..... 59/82; D11/25

[58] Field of Search ..... 59/82, 80; 63/4, 5, 63/5 R; D11/93, 19, 25; 224/164, 165, 173, 179

[56] References Cited

U.S. PATENT DOCUMENTS 3,237,395 10/1966 Bennett ..... 59/82
3,673,795 7/1972 Nielson ..... 59/80
3,924,418 12/1975 Bürkle, Jr. ..... 63/4
3,994,126 11/1976 Rieth ..... 59/80
4,245,461 1/1981 Bert ..... 59/82

FOREIGN PATENT DOCUMENTS 2071990 9/1981 United Kingdom ..... 224/164

*Primary Examiner*—Francis S. Husar
*Assistant Examiner*—Linda McLaughlin
*Attorney, Agent, or Firm*—Thompson, Birch, Gauthier & Samuels

[57] ABSTRACT

A non-expansible linkage bracelet has a basic skeletal structure made up of interlocked sets of top and bottom links covered by decorative shells which also are interlocked with the top and bottom links.

14 Claims, 17 Drawing Figures

NON-EXPANSIBLE LINKAGE BRACELET

BACKGROUND OF THE INVENTION

1. Field of the Invention

This invention relates generally to bracelets and other like jewelry articles, and is concerned in particular with non-expansible linkage bracelets of the type used with wrist watches and the like.

2. Description of the Prior Art

In the known non-expansible linkage bracelets of the type disclosed for example in U.S. Pat. No. 4,245,461 (Bert), a set of laterally adjacent top links is interlocked with a set of laterally adjacent bottom links. In addition to serving as basic structural components of the bracelet, the top links also serve the added function of providing the bracelet with an aesthetically pleasing appearance. Thus, the top links usually are decoratively shaped and/or embossed, as well as being plated with a precious metal such as for example gold or silver.

The functional duality of the top links presents the manufacturer with several problems. For example, because the top links are part of the basic bracelet structure, they must have sufficient thickness and strength to withstand normal usage. However, such thicknesses make it impractical to provide the top links with rolled gold plate material. Instead, the top links usually are electroplated, which considerably complicates the manufacturing process in addition to increasing unit costs. Also, because of the ever changing decorative designs of the top links, it is often difficult if not impossible to manufacture them in economically large quantities. This adds still further to the unit costs of the bracelets.

SUMMARY OF THE INVENTION

A basic objective of the present invention is to avoid the above-mentioned problems by eliminating the functional duality of the top links. In the preferred embodiments of the invention to be described hereinafter in more detail, this is accomplished by providing a bracelet having a basic skeletal structure made up of interlocked sets of top and bottom links, with the design of the links in both sets being governed essentially by non-aesthetic structural requirements, e.g., strength, durability, etc. This basic skeletal structure is then covered with decorative shells which also are interlocked with the top and bottom links, and whose sole function is to provide the bracelet with an aesthetically pleasing appearance. Thus, functional duality is largely eliminated, i.e., the basic skeletal structure provides needed strength and durability, whereas the decorative shells provide the needed aesthetics. With this arrangement, the top and bottom links can be manufactured economically in large lots for assembly into standard skeletal structures which can then be used with a wide variety of decorative shell designs. The shells can be manufactured from thinner stock with rolled precious metal platings, thus eliminating the need to resort to more complicated and costly electroplating techniques.

These and other objects and advantages of the present invention will be described hereinafter in more detail in connection with the following drawings, wherein:

DETAILED DESCRIPTION OF PREFERRED EMBODIMENTS

Figure 1:
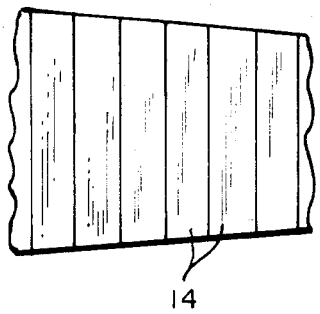
FIG. 1 is a partial top plan view of a bracelet in accordance with the present invention.
Figure 2:
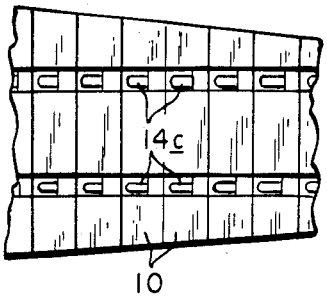
FIG. 2 is a partial bottom plan view of the bracelet shown in FIG. 1.
Figure 3:
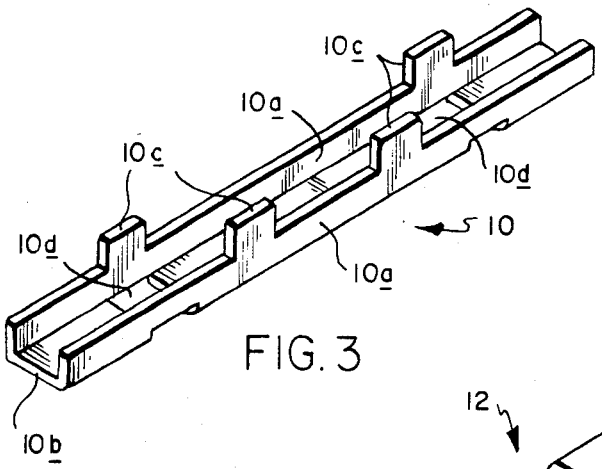
FIG. 3 is a perspective view of a bottom or "first" link.
Figure 4:
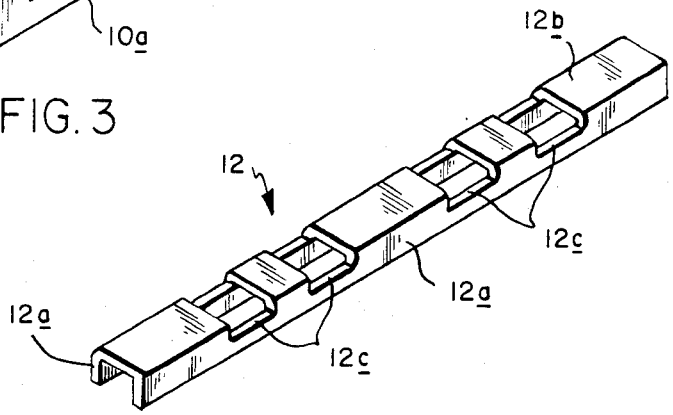
FIG. 4 is a perspective view of a top or "second" link.
Figure 5:
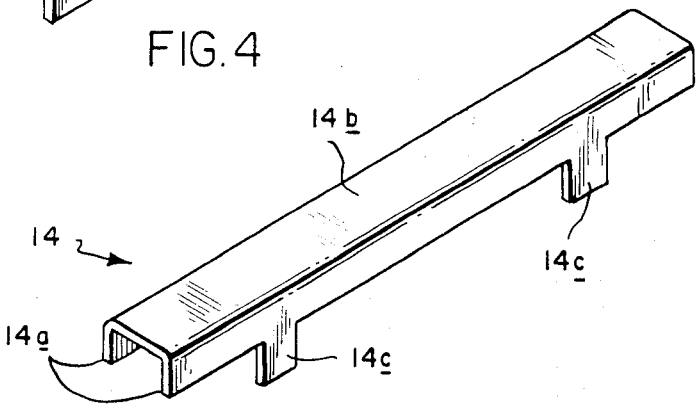
FIG. 5 is a perspective view of a typical decorative shell.

Referring now to the drawings, FIGS. 1 and 2 are partial top and bottom plan views respectively of a bracelet embodying bottom links 10 of the type shown in FIG. 3, top links 12 of the type shown in FIG. 4, and decorative shells 14 of the type shown in FIG. 5.

The bottom links 10 have channel-shaped cross sections with first side members **10*a* joined by first intermediate members 10*b*. The first side members each have at least one and preferably several first locking lugs 10*c* protruding therefrom, and the first intermediate members 10*b* are provided with first openings 10*d***.

The top links 12 also have channel-shaped cross sections with second side members **12*a* joined by second intermediate members 12*b*, the latter having second openings 12*c*** therein.

The shells 14 have channel-shaped cross sections with third side members **14*a* joined by third intermediate members 14*b*. One of the third side members has second locking lugs 14*c*** protruding therefrom.

Figure 6:
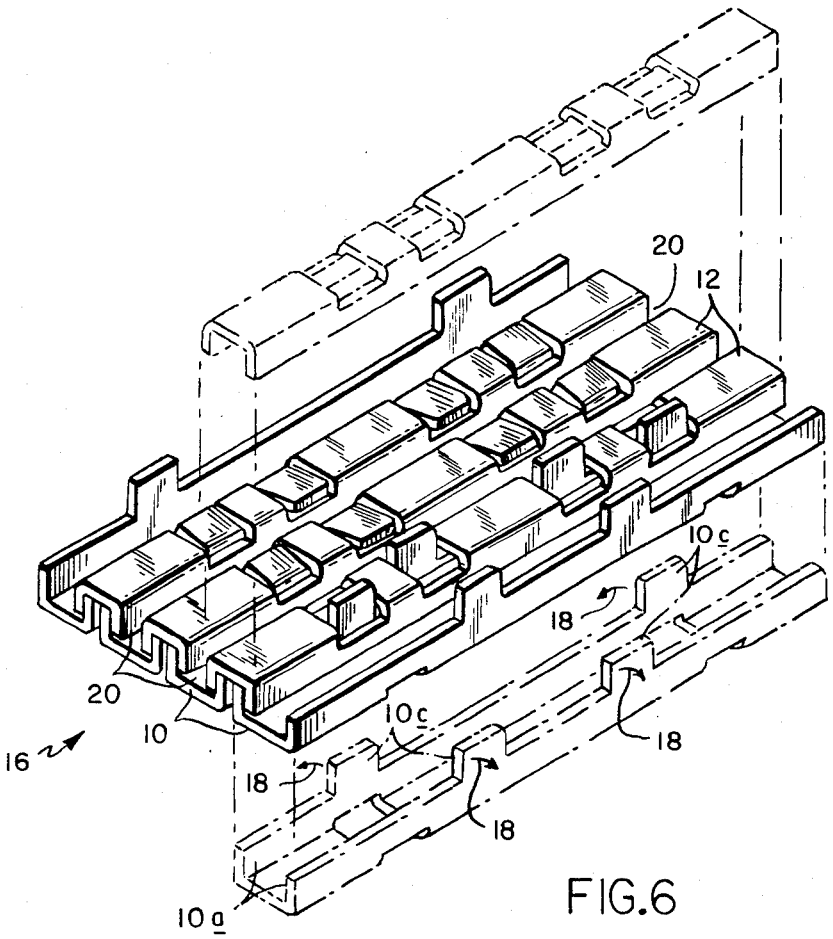
FIG. 6 is a top perspective view showing the top portion of the basic skeletal structure prior to the application thereto of decorative shells.
Figure 7:
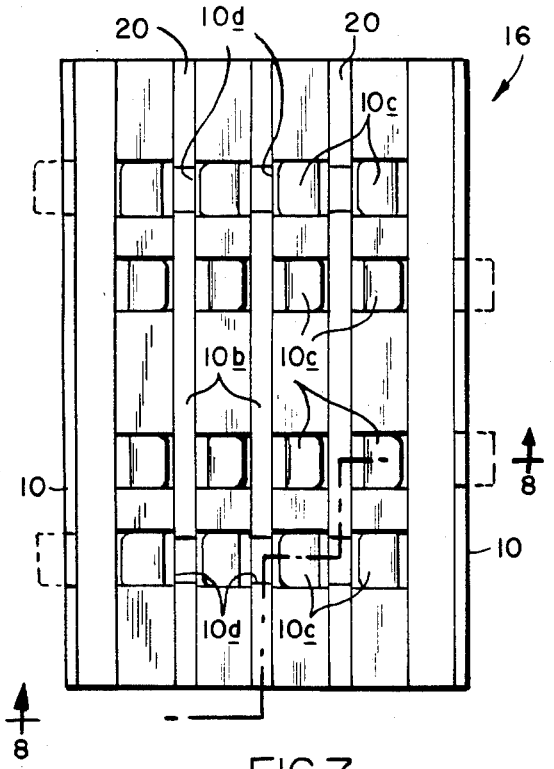
FIG. 7 is a top plan view of the skeletal structure shown in FIG. 6.
Figure 8:
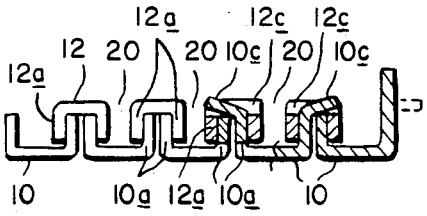
FIG. 8 is a sectional view taken along line 8—8 of FIG. 7.
Figure 9:
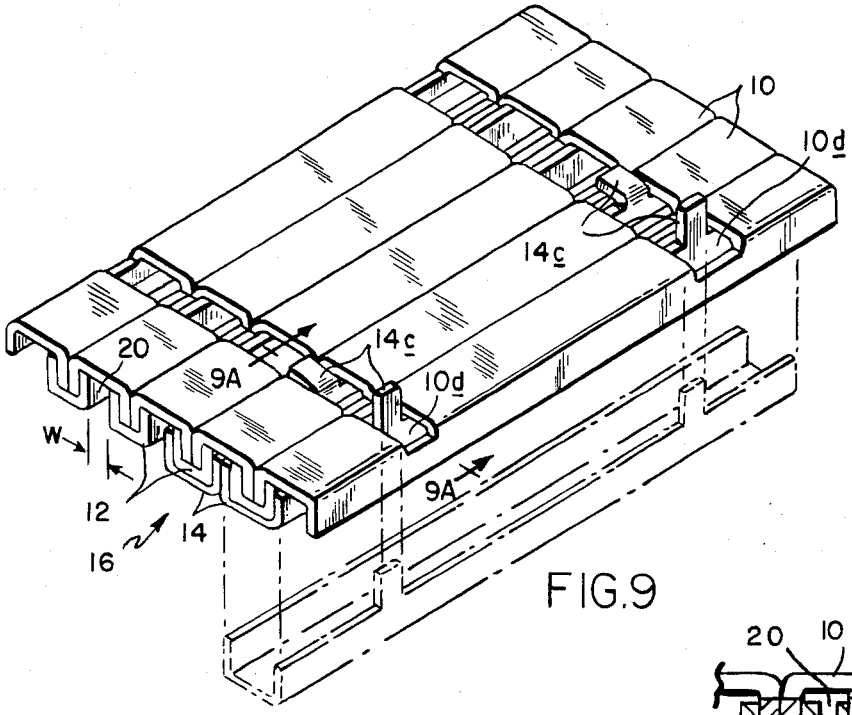
FIG. 9 is a perspective view of the bottom portion of the skeletal structure showing the application of decorative shells of the type shown in FIG. 5.
Figure 9A:
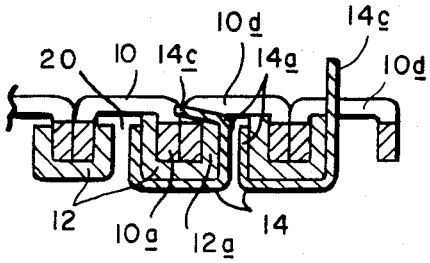
FIG. 9A is a sectional view taken along line 9A—9A of FIG. 9.

As can best be seen in FIGS. 6–8, sets of the bottom and top links 10, 12 are adapted to be interlocked to form a basic skeletal structure generally indicated at 16. In this structure, the channel-shaped cross sections of the top links 12 are inverted relative to the channel-shaped cross sections of the bottom links 10. As shown in FIG. 8, successive bottom links have their confronting first side members **10*a* located adjacent to and confined between the second side members 12*a* of individual top links 12. The first locking lugs 10*c* protrude through the second openings 12*c* and are then bendably deformed to overlap adjacent first and second side members 10***a*, 12*a*. As schematically indicated by the arrows 18 in FIG. 6, each bottom link has the locking lugs 10*c* on one of its side members 10*a* bent in a direction opposite to that of the locking lugs on its other side member. This interlocks the top and bottom links into the skeletal structure 16, with successive bottom links 10 being laterally adjacent to each other, and with successive top links 12 having spaces 20 therebetween. As is best shown in FIG. 7, the spaces 20 overlie the first intermediate members 10*b* of the bottom links 10, thereby partially exposing the first openings 10*d*. The design of the bottom and top links 10, 12 is governed essentially by structural considerations such as strength and durability, and with little if any regard to aesthetic considerations. The resulting skeletal structure 16, which is thus sturdy and wear resistant, is basic to a wide variety of decorative shells. For example, as shown in FIGS. 9 and 9A, the skeletal structure 16 can be covered with the relatively plain narrow shells 14 shown in FIG. 5. The shells 14 overlie individual top links 12, with their third side members 14*a* located in the spaces 20, and with their second locking lugs 14*c* protruding through the first openings 10*d* and being bendably deformed to overlap adjacent first and second side members 10*a*, 12*a*.

Preferably, the second locking lugs 14*c* are all bendably deformed in the same direction, and the width "W" (see FIG. 9) of the spaces 20 is only slightly larger than the combined thickness of two third side members 14*a*. As is best shown in FIG. 1, this provides the bracelet with a substantially continuous and unbroken decorative top surface.

Figure 10:
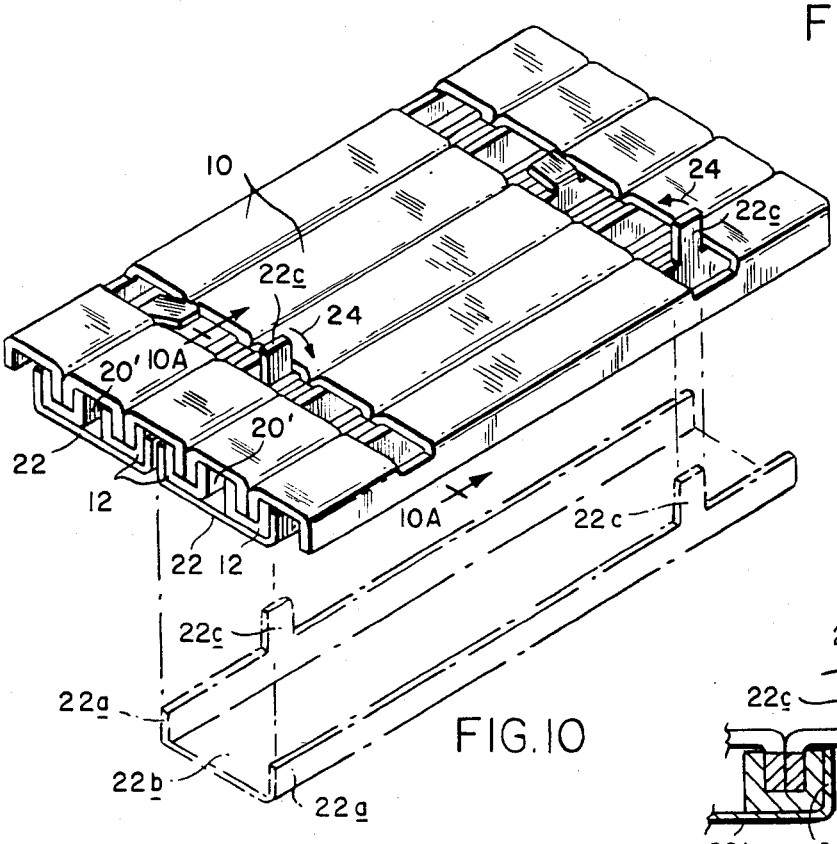
FIG. 10 is a view similar to FIG. 9 showing the application of substantially wider decorative shells to the skeletal structure.
Figure 10A:
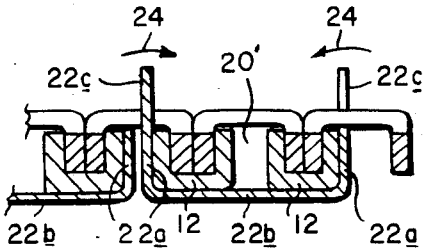
FIG. 10A is a sectional view taken along line 10A—10A of FIG. 10.

As previously indicated, the basic skeletal structure 16 can be used with a variety of different types and styles of decorative shells. For example, as shown in FIGS. 10 and 10A, channel-shaped top shells 22 of increased width can be employed to overlie pairs of top links 12. The top shells 22 are again provided with side members 22*a* joined by intermediate members 22*b*. In this case, each side member has a single locking lug 22*c* protruding therefrom. With this type of top shell, as shown in FIG. 10A, every other space 20′ between the top links 12 will remain empty. Also, the locking lugs 22*c* of individual shells will be bent in the opposite directions diagrammatically indicated by the arrows 24.

Figure 12A:
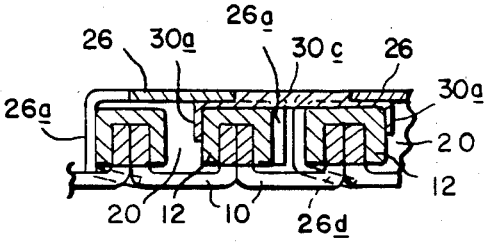
FIG. 12A is a sectional view on an enlarged scale taken along line 12A—12A of FIG. 12.
Figure 11:
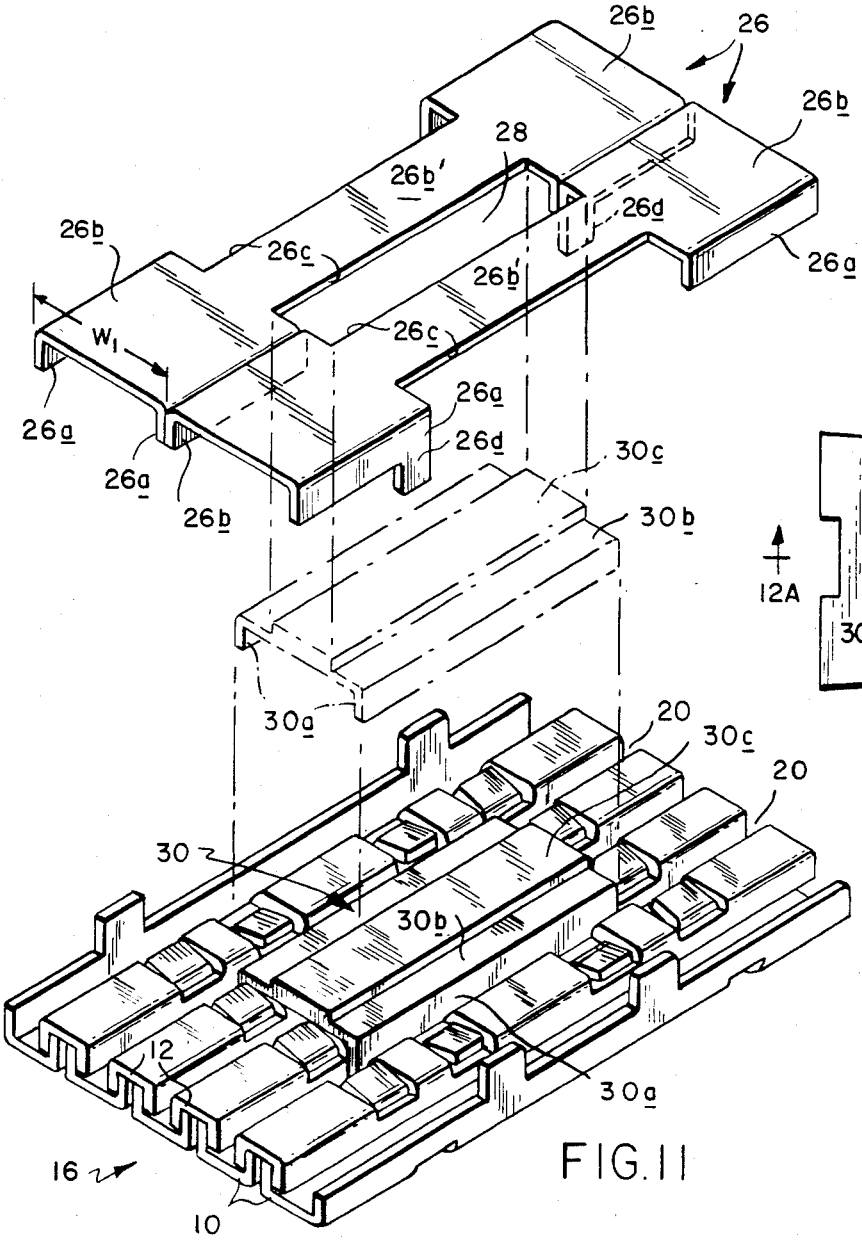
FIG. 11 is a top perspective view of the skeletal structure showing the application thereto of shells adapted to accommodate decorative inserts.
Figure 12:
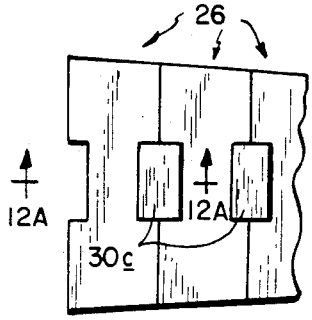
FIG. 12 is a top plan view of the bracelet assembly shown in FIG. 11.

FIGS. 11, 12 and 12A show another type of decorative covering for the basic skeletal structure 16. Here, the top shells 26 have channel-shaped cross sections at their opposite ends defined by side members 26*a* joined by intermediate members 26*b*. The side members 26*a* extend only partly inwardly from the shell ends, and thus the channel-shaped ends are interconnected by planar portions 26*b*′ of the intermediate members. The planar portions 26*b*′ are provided with recesses 26*c* which are located laterally within the width dimensions $W_1$ of the channel-shaped cross sections. Thus, adjacent shells 26 define openings 28 arranged to accommodate inserts 30. The top shell side members 26*a* are again provided with bendable locking lugs 26*d*. The inserts also have channel-shaped cross sections with side members 30*a* joined by intermediate members 30*b*, the latter having bosses 30*c* protruding therefrom. The inserts 30 are located midway between the side edges of the skeletal structure, with each insert straddling two top links 12, and with the insert side members 30*a* received in the spaces 20 between the top links. The bosses 30*c* protrude into the openings 28 defined by adjacent top shell recesses 26*c*. The top shells 26 also straddle pairs of top links 12, with their locking lugs 26*d* being received in the bottom link openings 10*d* and being bendably deformed to overlap adjacent side members 10*a*, 12*a* of the bottom and top links. In order to further heighten the decorative effect of this arrangement, the inserts 30 can be plated with or fabricated of materials which contrast with the plating of the shells 26.

Figure 13:
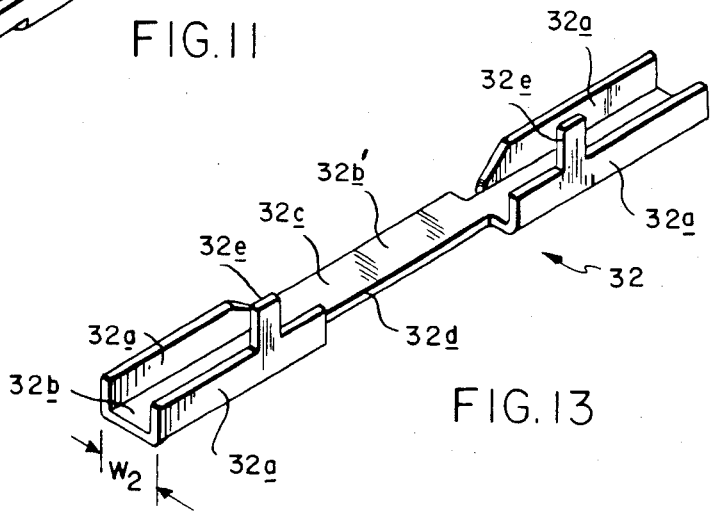
FIG. 13 is a perspective view of still another type of decorative shell.
Figure 14:
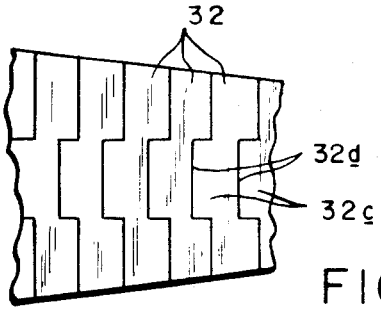
FIG. 14 is a partial top plan view of a bracelet embodying decorative shells of the type shown in FIG. 13.

FIG. 13 shows another type of top shell 32 which can be used with the basic skeletal structure 16. Shell 32 has channel-shaped cross sections at its opposite ends defined by side members 32*a* joined by an intermediate member 32*b*. The intermediate member 32*b* has a planar intermediate portion 32*b*′ with a flange 32*c* on one side which protrudes laterally beyond the width dimension $W_2$ of the channel-shaped end sections, and a recess 32*d* on the opposite side which is located laterally within the same width dimension. One of the side members 32*a* is provided with locking lugs 32*e*. The shells 32 are connected to the basic skeletal structure 16 in essentially the same manner as described previously in connection with shells 14. As shown in FIG. 14, the shells 32 provide a decorative pattern wherein the shell flanges 32*c* are received in the recesses 32*d* of adjacent shells.

In all cases, after the top shells have been mounted on the basic skeletal structure, the side edges of the assembly can be finished as by grinding and polishing to provide the bracelet with a selected shape, which is usually gently tapered as shown for example in FIGS. 1, 2, 12 and 14.

In light of the foregoing, it now will be appreciated by those skilled in the art that the present invention offers the designer a wide selection of shapes and materials for the top shells, all of which can be employed with the same basic skeletal structure. Thus, the components of the skeletal structure can be mass produced and assembled in large lots, with significant attendant economies. Since the top shells function essentially as decorative rather than structural components, they can be manufactured more economically of thinner gauge materials, thus providing still further savings in costs.

I claim:

1. A non-expansible linkage bracelet comprising:

a set of first links having channel-shaped cross sections with first side members joined by first intermediate members, said first side members each having at least one first locking lug protruding therefrom and said intermediate members having first openings therein;

a set of second links having channel-shaped cross sections with second side members joined by second intermediate members having second openings therein, the channel-shaped cross sections of said second links being inverted relative to the channel-shaped cross sections of said first links and being positioned such that successive first links having confronting first side members located adjacent to and confined between second side members of individual second links, with said first locking lugs protruding through said second openings and being bendably deformed to overlap adjacent first and second side members in a manner which interlocks said first and second links into a skeleton structure having successive first links laterally adjacent to each other and successive second links laterally spaced from each other; and a set of shells having channel-shaped cross sections with third side members joined by third intermediate members, at least one of said third side members on each of said shells having at least one second locking lug protruding therefrom, the channel-shaped sections of said shells being arranged to overlie said second links, with said third side members being located in the spaces between said second links, and with said second locking lugs protruding through said first openings and being bendably deformed to overlap adjacent first and second side members in a manner which interlocks said shells to said skeleton structure.

2. The linkage bracelet of claim 1 wherein said shells are laterally adjacent to each other, thereby providing a substantially continuous surface which substantially completely covers said skeleton structure.

3. The linkage bracelet of claim 1 wherein the first locking lugs on the first side member of said first link are bendably deformed in opposite directions.

4. The linkage bracelet of claim 3 wherein each shell overlies a single second link, and wherein said second locking lugs all are bendably deformed in the same direction.

5. The linkage bracelet of claim 3 wherein each shell overlies a plurality of second links, and wherein the second locking lugs on said third side members are bendably deformed in opposite directions.

6. The linkage bracelet of claim 1 wherein the channel-shaped cross sections of said first links have a width dimension which is greater than the width dimension of the channel-shaped cross sections of said second links.

7. The linkage bracelet of claim 6 wherein the inside spacing between the second side members of each second link is only slightly greater than the combined thickness of two first side members.

8. The linkage bracelet of either claim 4 or claim 7 wherein the inside spacing between the third side members of each shell is only slightly greater than twice the thickness of a first side member plus twice the thickness of a second side member.

9. The linkage bracelet according to any one of claims 1 to 7 wherein the channel-shaped cross sections of said shells are located at opposite ends thereof and are spaced by substantially planar sections.

10. The linkage bracelet of claim 9 wherein said planar sections define flanges extending laterally beyond the width dimensions of the channel-shaped cross sections of said shells, and recesses which are located laterally within said width dimensions, with a flange on one shell being received in a corresponding recess in the next adjacent shell.

11. The linkage bracelet according to any one of claims 1 or 3 to 7 wherein the channel-shaped cross sections of said shells are located at opposite ends thereof and are spaced by substantially planar sections, said planar sections having recesses which are located laterally within the width dimensions of the channel-shaped cross sections of said shells, with the recesses of successive shells defining openings occupied by inserts.

12. The linkage bracelet of claim 11 wherein said inserts have a channel-shaped cross section with fourth side members joined by fourth intermediate members, said fourth intermediate members being at least partially overlapped by the planar sections of said shells, and said fourth side members being received in the spaces between said second links.

13. The linkage bracelet of claim 12 wherein said fourth intermediate members have bosses protruding into said openings.

14. A non-expansible linkage bracelet comprising: a skeletal structure consisting of sets of top and bottom links being interlocked channel-shaped cross sections, the said top links having spaces therebetween exposing openings in said bottom links; and, decorative shells overlying said top links, said shells having channel-shaped cross sections extending into said spaces with locking lugs protruding through said openings, said locking lugs being bendably deformed to establish an interlocked relationship between said shells and said skeletal structure.

* * * * *